US006424313B1

(12) United States Patent
Navarro et al.

(10) Patent No.: US 6,424,313 B1
(45) Date of Patent: Jul. 23, 2002

(54) THREE DIMENSIONAL PACKAGING ARCHITECTURE FOR PHASED ARRAY ANTENNA ELEMENTS

(75) Inventors: Julio Angel Navarro, Kent; Douglas Allan Pietila, Puyallup; Dietrich E. Riemer, Kent, all of WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/650,947

(22) Filed: Aug. 29, 2000

(51) Int. Cl.[7] ..... H01Q 23/00
(52) U.S. Cl. ..... 343/853; 343/770
(58) Field of Search ..... 343/853, 779, 343/777, 767, 778, 770; 342/158; H01Q 23/00

(56) References Cited

U.S. PATENT DOCUMENTS

| | | | | |
|---|---|---|---|---|
| 4,806,941 A | | 2/1989 | Knochel et al. | |
| 5,008,678 A | * | 4/1991 | Herman | 342/158 |
| 5,136,304 A | | 8/1992 | Peters | 343/777 |
| 5,219,377 A | | 6/1993 | Poradish | |
| 5,276,455 A | | 1/1994 | Fitzsimmons et al. | 343/777 |
| 5,488,380 A | | 1/1996 | Harvey et al. | |
| 5,675,345 A | | 10/1997 | Pozgay et al. | |
| 5,825,333 A | * | 10/1998 | Kudoh et al. | 343/853 |
| 5,886,671 A | | 3/1999 | Riemer et al. | 343/776 |
| 6,018,659 A | | 1/2000 | Ayyagari et al. | 455/431 |

OTHER PUBLICATIONS

Publication from Microwave Journal, Jan. 1994, entitled "A Connectorless Module for an EHF Phased–Array Antenna".

PCT International Search Report filed Aug. 29, 2000.

* cited by examiner

*Primary Examiner*—Michael C. Wimer
(74) *Attorney, Agent, or Firm*—Harness Dickey & Pierce P.L.C.

(57) ABSTRACT

An electronically steerable phased array antenna module having a conformable circuit element. The conformable circuit element forms a packaging architecture which includes a flexible substrate on which the control electronics of the antenna can be mounted directly or electrically coupled to the flexible substrate. The radiating elements are integrally formed on the substrate together with monolithic transmission lines which couple the radiating elements to the integrated circuits forming the control electronics. In one preferred embodiment, integrated power combiner/splitters may be integrally formed on the conformable circuit element and integrated transmission feed lines are formed on the circuit element coupling the power combiner/splitter circuits to the control electronics. The conformable circuit element provides a packaging architecture which enables a large plurality of antenna radiating elements and associated interconnecting transmission and feed to be packaged in a cost efficient and compact manner, and which can be easily adapted for a variety of different forms of phased array antennas.

10 Claims, 9 Drawing Sheets

THREE DIMENSIONAL PACKAGING ARCHITECTURE FOR PHASED ARRAY ANTENNA ELEMENTS

TECHNICAL FIELD

This invention relates to phased array antennas, and more particularly to a three dimensional packaging architecture for forming a high frequency, electronically steerable phased array antenna module with a greatly reduced number of external interconnecting elements.

BACKGROUND OF THE INVENTION

Phased array antennas are comprised of multiple radiating antenna elements, individual element control circuits, a signal distribution network, signal control circuitry, a power supply and a mechanical support structure. The total gain, effective isotropic radiated power ("EIRP") (with a transmit antenna) and scanning and side lobe requirements of the antenna are directly related to the number of elements in the antenna aperture, the individual element spacing and the performance of the elements and element electronics. In many applications, thousands of independent element/control circuits are required to achieve a desired antenna performance.

A phased array antenna typically requires independent electronic packages for the radiating elements and control circuits that are interconnected through a series of external connectors. As the antenna operating frequency (or beam scan angle) increases, the required spacing between the phased array radiating elements decreases. As the frequency increases, the required spacing becomes smaller. As the spacing of the elements decreases, it becomes increasingly difficult to physically configure the control electronics relative to the tight element spacing. This can affect the performance of the antenna and/or increase its cost, size and complexity. Consequently, the performance of a phased array antenna becomes limited by the need to tightly package and interconnect the radiating elements and the element electronics associated therewith with the required number of external connectors. As the number of radiating elements increases, the corresponding increase in the required number of external connectors (i.e., "interconnects") serves to significantly increase the cost of the antenna.

Additionally, multiple beam antenna applications further complicate this problem by requiring more electronic components and circuits to be packaged within the same module spacing. Conventional packaging approaches for such applications result in complex, multi-layered interconnect structures with significant cost, size and weight.

FIG. 1 illustrates one form of architecture, generally known as a "tile" architecture, used in the construction of a phased array antenna. With the tile architecture approach, an RF input signal is distributed into an array in a distribution layer 10 that is parallel to the antenna aperture plane. The distribution network 10 feeds an intermediate plane 12 that contains the control electronics 14 responsible for steering and amplifying the signals associated with individual antenna elements. A third layer 16 includes the antenna elements 18. The third layer 16 comprises the antenna aperture and typically includes a large plurality of closely spaced antenna elements 18 which are electronically steerable by the control electronics 14. Output signals radiate as a plurality of individually controlled beams from antenna radiating elements 18.

With the tile architecture approach described in FIG. 1, the radiating element 18 spacing determines the available surface area for mounting the electronic components 14.

The tile architecture approach can be implemented for individual elements or for an array of elements. An important distinction of the traditional tile architecture approach is its ability to readily support dual polarization radiators as a result of its coplanar orientation relative to the antenna aperture. Individual element tile configurations can also allow for complete testing of a functional element prior to antenna integration. Ideally, the tile configuration lends itself to most manufacturing processes and has the best potential for low cost if the electronics can be accommodated for a given element spacing. This configuration also requires discrete interconnects for each layer in the structure, where the number of interconnects required is directly in accordance with the number of radiating elements of the antenna. Additionally, the mechanical construction of the individual tiles in the array typically contributes to limitations on the minimum element spacing that can be achieved.

A tile architecture configuration for a phased array antenna can also be implemented in multiple element configurations. As such, the tile architecture approach can take advantage of distributed, routed interconnects resulting in fewer components at the antenna level. The tile architecture approach also takes advantage of mass alignment techniques providing opportunities for lower cost antennas. The multiple element configuration, however, does not support individual element testing and consequently is more severely impacted by process yield issues confronted in the manufacturing process. Conventional enhancements to the basic tile architecture approach have involved multiple layers of interconnects and components, which increases antenna cost and complexity.

FIG. 2 illustrates a different form of packaging architecture known generally as a "brick" or "in-line" packaging architecture. With the brick architecture, the input signal is distributed in a 1×N feed layer 20. This distribution layer feeds N 1×M distributions 22–36 that are arranged perpendicular to the 1×N feed layer 20 and the antenna aperture plane. With the brick architecture, the radiating elements 38 on each distribution layer 22 are arranged in line with the element electronics 38 (shown in highly simplified form). Because of the in-line configuration of the radiating elements 38 and their orthogonal arrangement to the antenna aperture, the traditional brick architecture approach is typically limited to single polarization configurations. Like the tile architecture approach, however, the radiating elements can be packaged individually or in multiple element configurations as shown in FIG. 2. External interconnects are used between the input feed layer 20 and the distribution layers 22. Typically, the brick architecture approach results in an antenna that is deeper and more massive than one employing a tile architecture approach for a given number of radiating elements. The brick architecture approach, however, can usually accommodate tighter radiating element spacing since the radiating element electronics are packaged in-line with the radiating elements 38. The ability to test individual radiating elements 38 prior to antenna integration is limited, with a corresponding rework limitation at the antenna level.

The assignee of the present application is a leading innovator in phased array antenna packaging and manufacturing processes involving modified tile and brick packaging architectures. The prior work of the assignee in this area is described in U.S. Pat. No. 5,886,671 to Riemer et al, issued Mar. 23, 1999 and U.S. Pat. No. 5,276,455 to Fitzsimmons et al, issued Jan. 2, 1994. The disclosures of both of these patents are hereby incorporated by reference into the present application. While the approaches described in these two patents address many of the issues and limitations of tile and brick packaging architectures, these approaches are still space limited as the frequency increases.

Accordingly, there is a need for a packaging architecture for a phased array antenna module which permits even closer radiating element spacing to be achieved, and which allows for even simpler and more cost efficient manufacturing processes to be employed to produce a phased array antenna.

More specifically, it is an object of the present invention to provide a packaging architecture for forming a phased array antenna module which significantly reduces the physical space required for interconnects between the electronics and the radiating elements of the antenna, as well as the need for external interconnecting elements for forming the transmission feed lines of the antenna module.

It is still another object of the present invention to provide a packaging architecture for a phased array antenna module which significantly simplifies the manufacturing of the antenna module, and which allows the antenna to be adapted for various implementations which require the radiating elements thereof to be disposed in various angular orientations relative to other portions of the antenna module.

SUMMARY OF THE INVENTION

The above and other objects are provided by a phased array antenna module employing a three dimensional packaging architecture. The antenna module of the present invention generally comprises a conformable circuit element forming a substrate having integrated, monolithic transmission lines, radiating elements and distribution feed lines. Since the conformable circuit element can be formed in a variety of shapes during assembly, the circuit element can be adapted for implementation in a wide variety of antenna configurations to suit specific applications.

The conformable circuit element comprises a multi layer flexible circuit element to which a plurality of electronic elements, typically monolithic microwave integrated circuits (MMICs) and application specific integrated circuits (ASICs), can be coupled. The radiating elements are formed directly on the conformable circuit element together with a corresponding plurality of integrated, monolithic transmission lines which electrically couple the radiating elements with the element electronics. A plurality of output pads are also formed on the conformable circuit element in communication with the monolithic feed transmission lines. Optionally, an integrated power combiner/splitter may be formed on the substrate in communication with the circuit elements. Also, flip chip MMICs and ASICs can be secured directly on the conformable circuit element if desired.

Since the conformable circuit element is flexible, it can be readily adapted for use in a variety of implementations. The integrated radiating elements, monolithic transmission lines and monolithic feed transmission lines eliminate the need for external interconnects, thus enabling the radiating elements to be packaged with even less spacing being required between the elements. Consequently, a receive and/or transmit antenna can be formed using the packaging and architecture of the present invention to incorporate a large number of radiating elements, associated electronics and interconnecting elements in a very compact and cost efficient assembly.

The flexibility afforded by the conformable circuit element allows the radiator elements to be placed at various angular orientations relative to the remainder of the conformable circuit element. This feature also enables the conformable circuit element to be secured to other components, such as a central core element, such as when forming a waveguide radiator.

As will be appreciated, the packaging architecture of the present invention also enables a receive and/or transmit antenna module to be constructed even more cost effectively than with previous variants of the brick and tile architecture approaches. The reduced manufacturing cost enables antenna modules constructed in accordance with the present invention to be used in an even greater number of applications where the use of a phased array antenna requiring hundreds or thousands of radiating elements would have previously been cost prohibitive.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
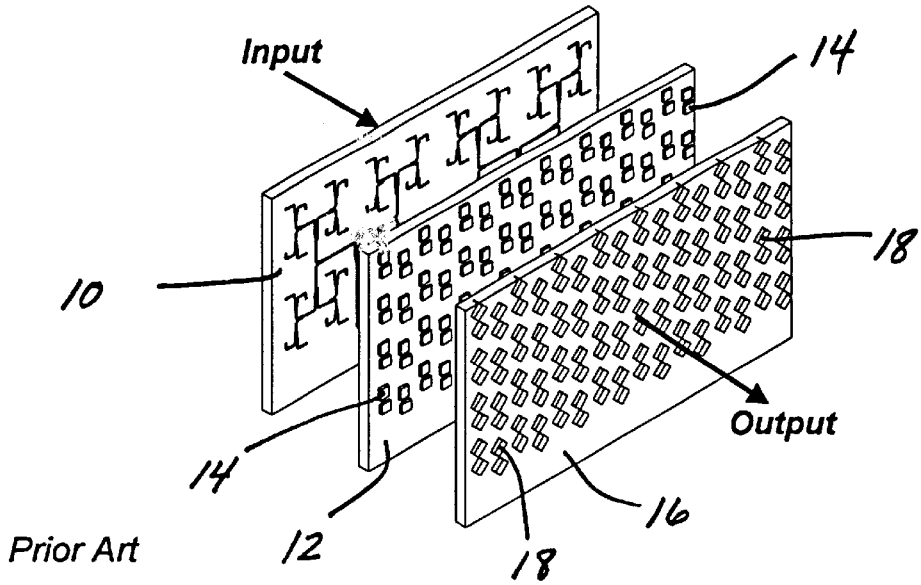
FIG. 1 is a simplified diagram of a tile architecture approach used in constructing an electronically steerable phased array antenna.
Figure 2:
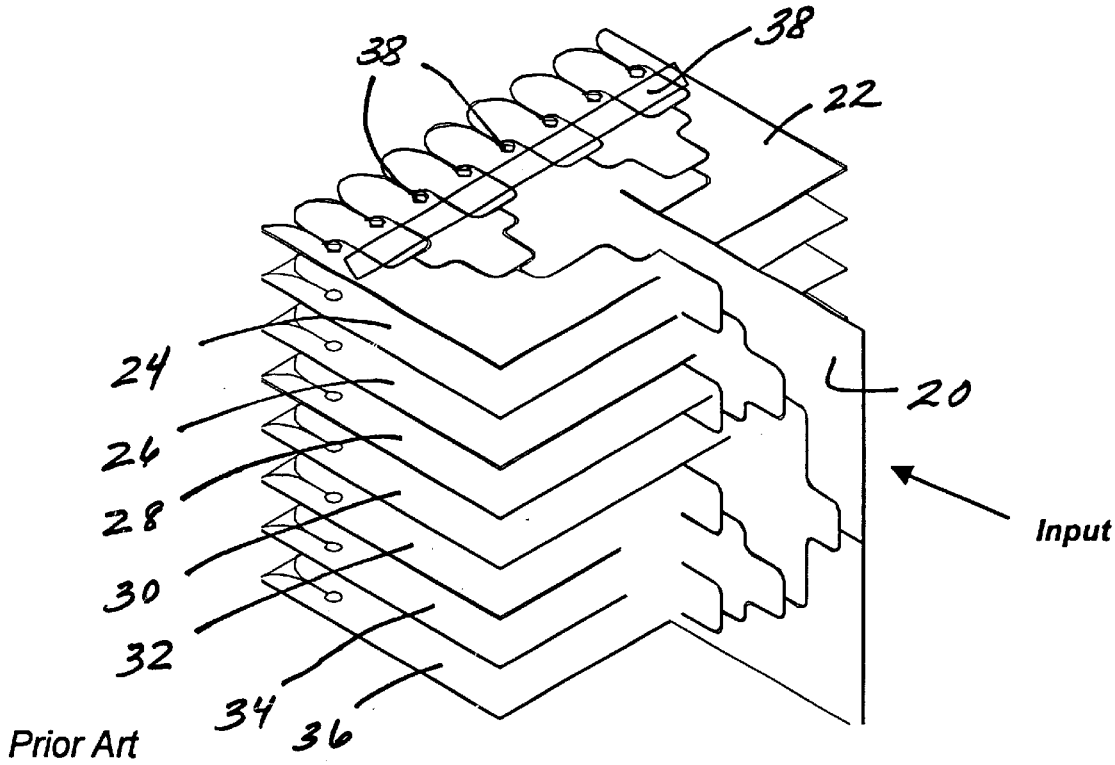
FIG. 2 is a diagram of a traditional brick architecture approach used in constructing a phased array antenna.
Figure 3:
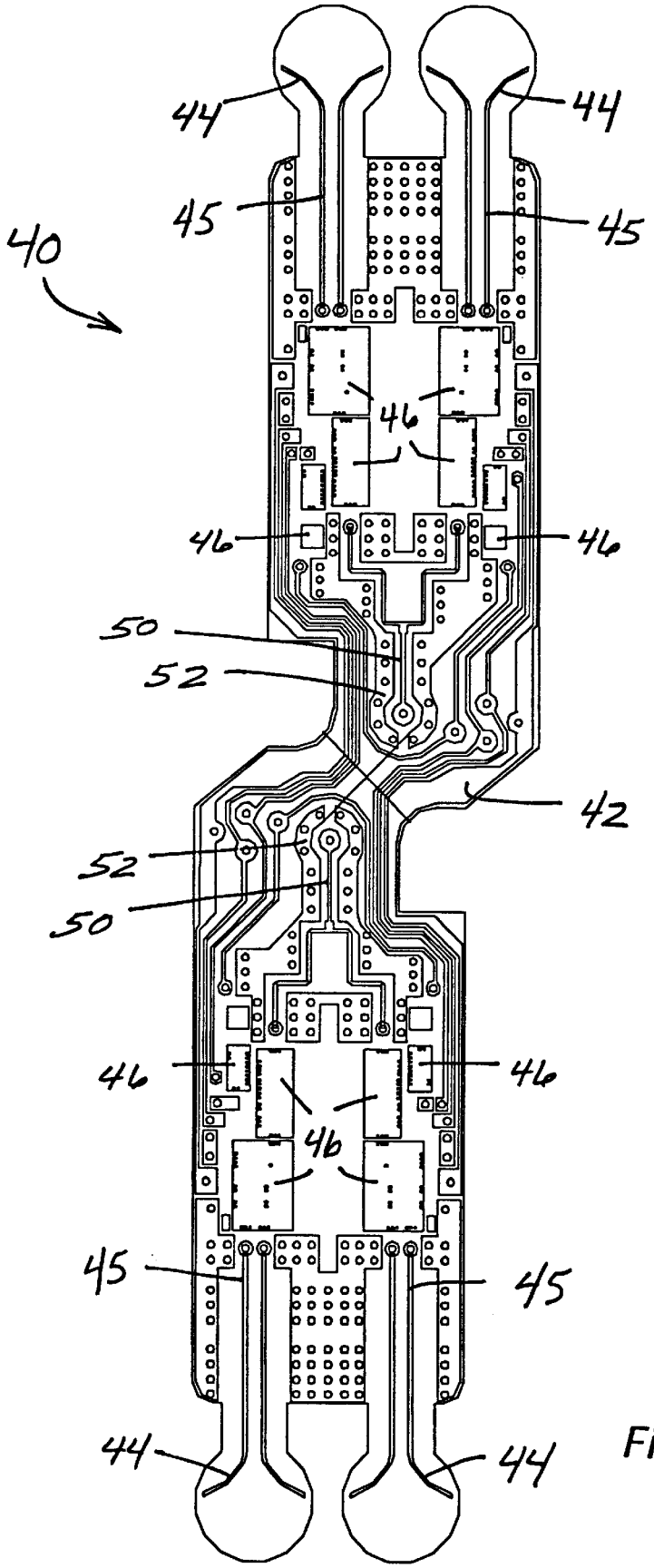
FIG. 3 is a plan view of a conformable circuit element in accordance with the present invention.

Referring to FIG. 3, there is shown an example of a conformable circuit element 40 for forming a phased array antenna module in accordance with the present invention. The conformable circuit element 40 is shown in a four element, 2×2 configuration. It will be appreciated that configurations having widely varying numbers of elements could be constructed as needed to suit specific applications. Thus, single element, dual element or other multiple element configurations are contemplated as being within the scope of the present invention.

The conformable circuit element 40 includes a flexible substrate 42. The substrate 42 is preferably a multi-layer substrate. The substrate 42 has formed thereon a plurality of radiating elements 44 (four in the exemplary embodiment shown) in electrical communication with a corresponding plurality of flip chip integrated circuits, designated generally by reference numeral 46, by a plurality of monolithic transmission lines 45 etched onto the substrate 42. Optionally, a pair of integrated, monolithic power combiner/splitters 48 may be secured on the substrate 42 and coupled to associated ones of the integrated circuits 46 via an associated plurality of integrated, monolithic feed transmission lines 50. Two groups of output pads 52 are similarly formed on the substrate 42. Each group of output pads 52 is in electrical communication with a respective one of the power combiner/splitters 48 via an associated subplurality of the monolithic feed transmission lines 50.

Since the conformable circuit element 40 is flexible, it can be adapted for use in a wide variety of different antenna configurations. As will also be appreciated, the integrally formed monolithic transmission lines 45 and feed transmission lines 50 eliminate the need for external interconnects, thus significantly reducing the overall manufacturing complexity and overall cost of a phased array antenna module.

Figure 4:
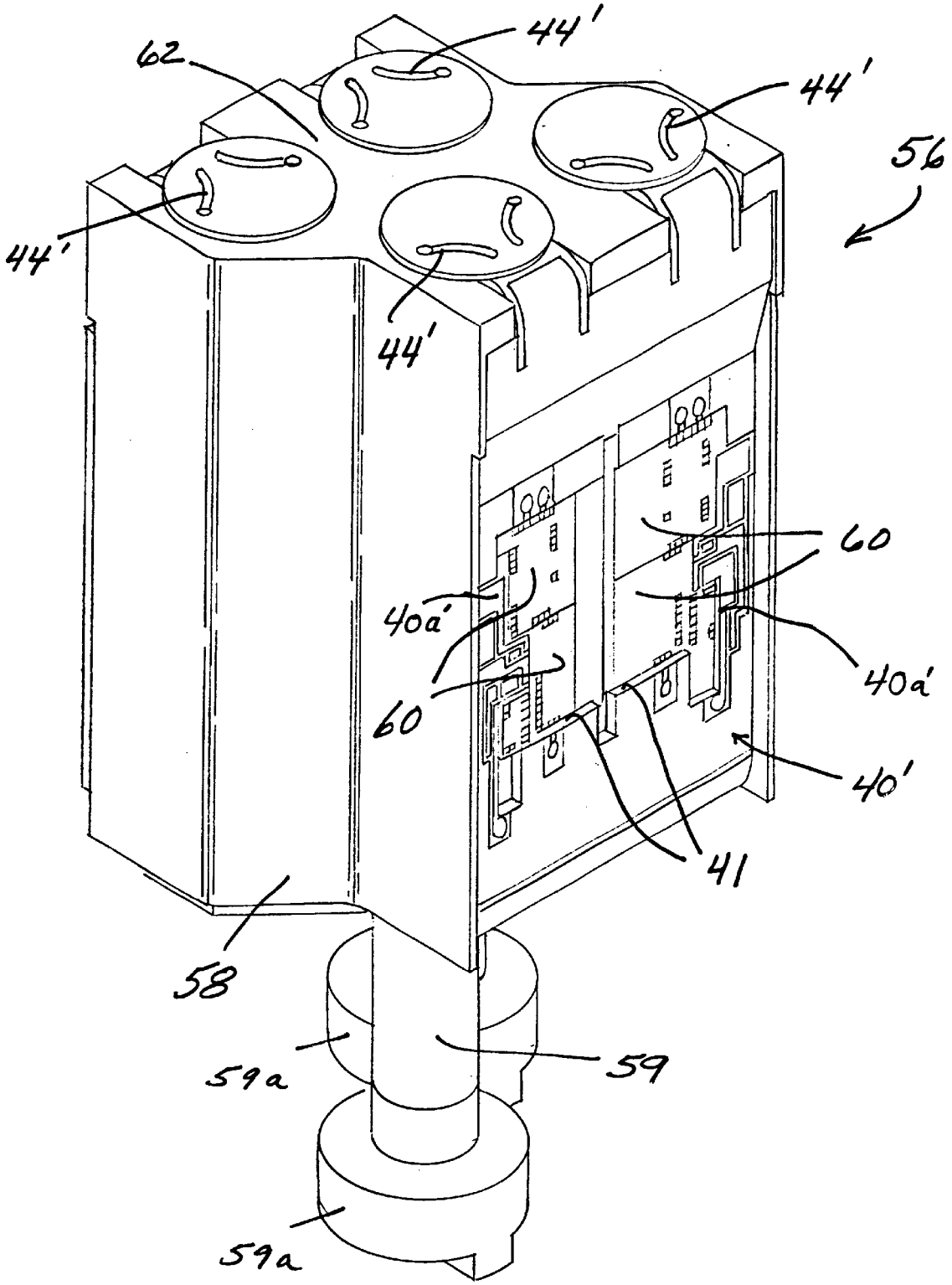
FIG. 4 is a perspective view of an alternative embodiment of the conformable circuit element shown in FIG. 3 having a 2×2 element, single beam configuration, and attached to a central core element to form a quad-element phased array antenna module in which the antenna aperture is orthogonal to the remainder of the conformable circuit element and the integrated circuits are secured directly to the core element.
Figure 5:
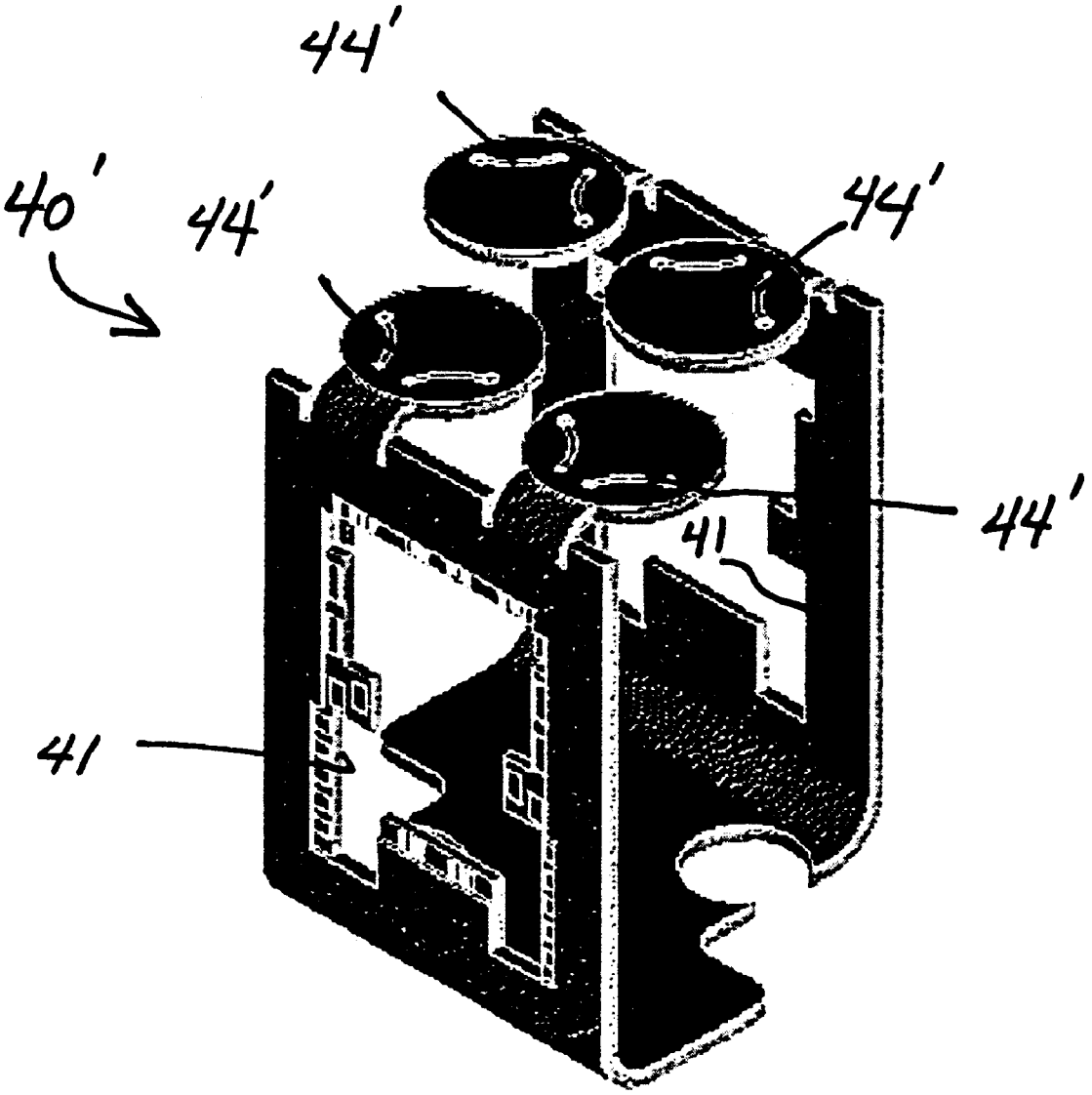
FIG. 5 is a perspective view of just the conformable circuit element formed into the shape it needs to assume prior to being secured to the core element shown in FIG. 4.
Figure 5A:
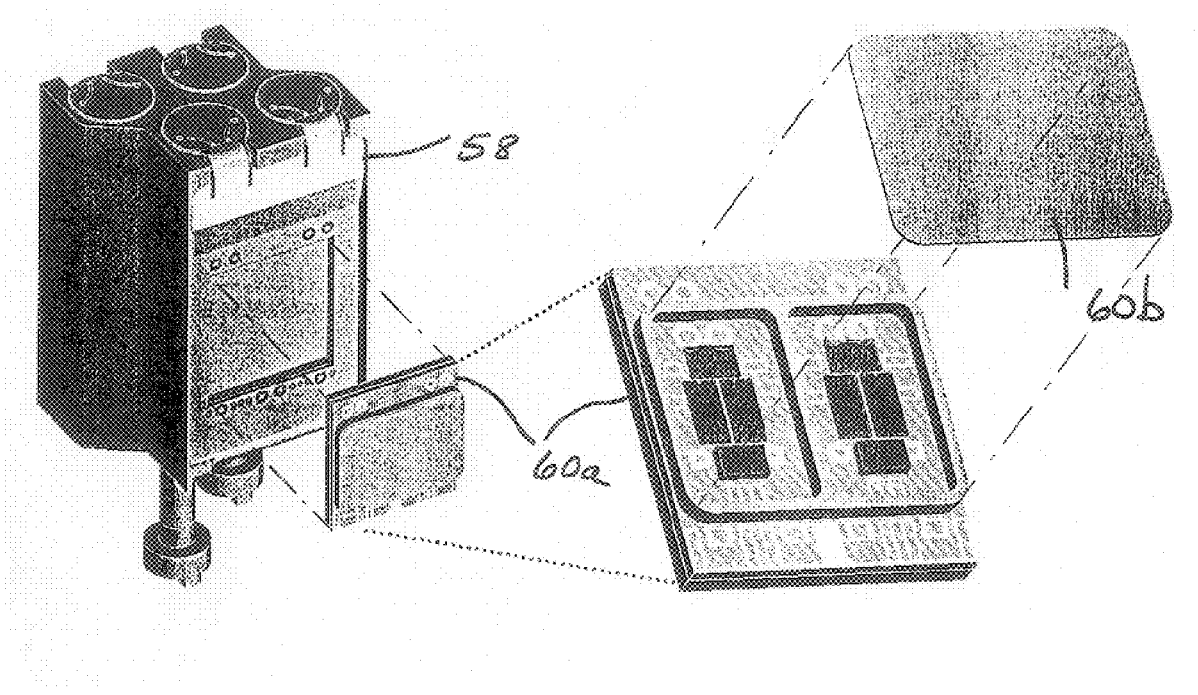
FIG. 5A is a perspective view of an alternative implementation of the conformable circuit element wherein hermetically sealed, ceramic chip carrier is used to house the MMICs and ASICs, and secured directly to the central core.

Referring now to FIG. 4, a quad-element, 2×2 phased array antenna module 56 is illustrated incorporating a conformable circuit element 40' in accordance with an alternative preferred embodiment of the present invention. Circuit element 40' is similar to circuit element 40 with the exception of cut-outs 41 for a plurality of beam steering elements in the form of MMICs and ASICs, generally designated by reference numeral 60. The module 56 incorporates a central core or mandrel 58 to which the conformable circuit element 40' is attached. In this implementation, the MMICs and ASICs 60 are die bonded to the central core 58 and positioned to fit within the cutouts 41. The MMICs and ASICs 60 are coupled to the conformable circuit element 40' by wire bonding ledge portions 40*a*' of the circuit element. The conformable circuit element 40', which is shown in FIG. 5 formed into the shape needed to fit around the central core 58, is preferably bonded via a suitable adhesive to the central core 58. It will be appreciated that other implementations, such as ceramic chip carrier mounting of the integrated electronic circuit components, could easily be employed. Such an implementation is illustrated in FIG. 5A, wherein a ceramic chip carrier 60*a* is used to support the MMICs and ASICs 60 on the central core 58. An additional advantage of this implementation is that the MMICs and ASICs 60 can be hermetically sealed within the chip carrier 60*a* via a cover 60*b*.

With further reference to FIG. 4, the MMICs and ASICs 60 are mounted vertically with respect to a radiating aperture plane 62 of the antenna 56, thus allowing a significant increase in chip attachment area per radiating element. The antenna aperture formed by aperture plane 62 is also orthogonal to the plane on which the MMICs and ASICs 60 are attached, and the radiating elements 44' are further interconnected through the monolithic transmission line feeds (not visible) without implementing external interconnects. It will be appreciated that the output pads (not visible) could be placed in any geometric orientation relative to the radiating elements 44'.

Figures 6, 7:
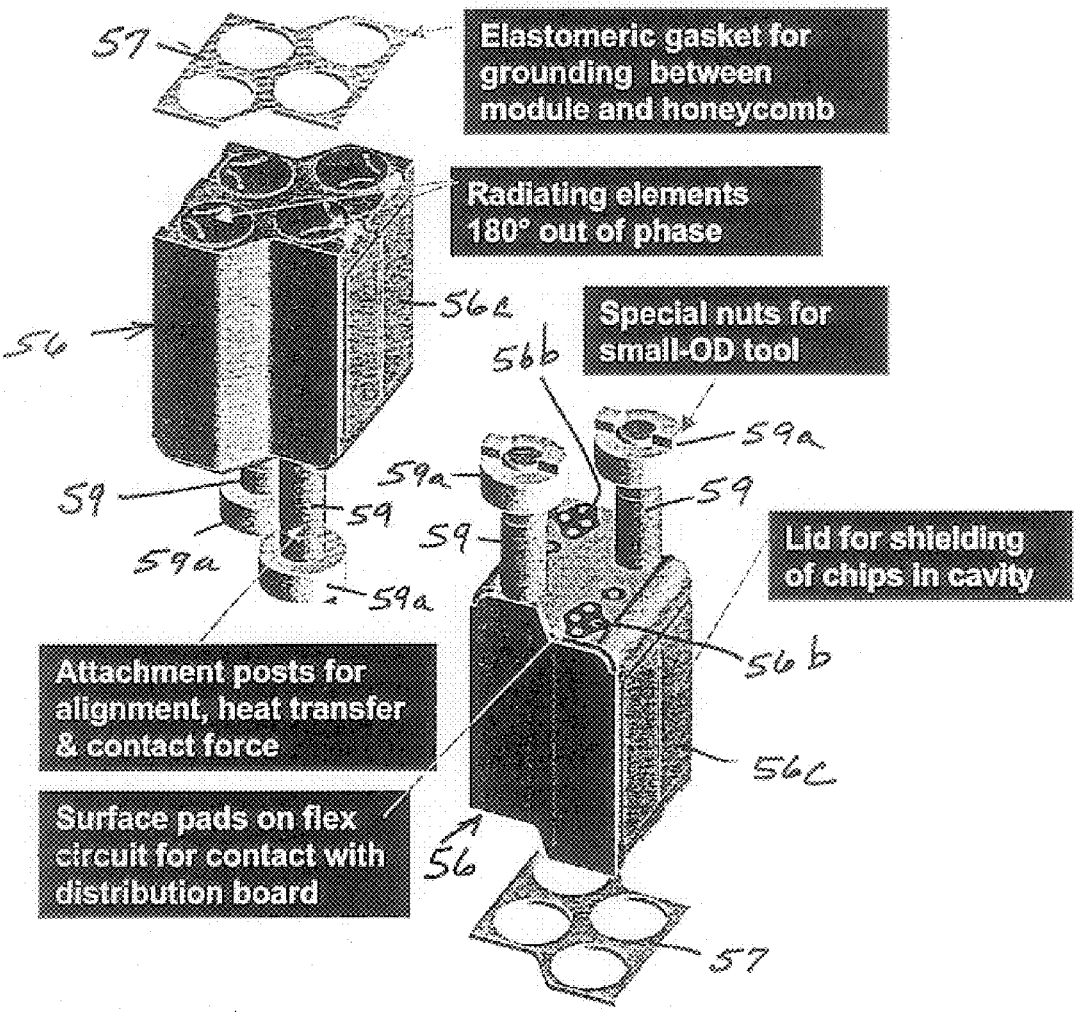
FIG. 6 is a perspective view of the antenna module of FIG. 4 shown with a shielding cover member attached thereto and a gasket used for grounding between the antenna and an external honeycomb plate.
FIG. 7 is a perspective view of the antenna of FIG. 6 turned upside down.

Referring to FIGS. 6 and 7, the antenna module 56 can also be seen to include an elastomeric gasket 57. Of course, gasket 57 could just as well comprise a washer which is mechanically compliant and electrically conductive. Gasket 57 facilitates assembly of the module 56 to a separate honeycomb plate (not shown), which is used when securing a number of modules 56 together in adjacent fashion. In this regard, it will be appreciated that hundreds, or possibly even thousands, of modules 56 are often required for forming an antenna aperture large enough to meet the needs of various applications. The gasket 57 helps to facilitate the mounting of large numbers of modules 56 when same are positioned adjacent to one another and has the compliance necessary for grounding the honeycomb plate to the central core 58.

In FIGS. 6 and 7, the mounting posts 59 can also be seen which allow the module 56 to be aligned and mounted to an external support frame (not shown). A pair of mounting nuts 59*a* are threadably engageable with the mounting posts 59. Surface pads 56*b* make contact with an external distribution board (not shown). Metal to metal contact is the preferred method, but an elastomeric connector, fuzz button, etc., could also be used. A lid 56*c* also is used for shielding the integrated circuit components 60 mounted on the module 56. The mounting posts 59 could be threadably secured within threaded bores in the central core 58 if desired.

Figure 8:
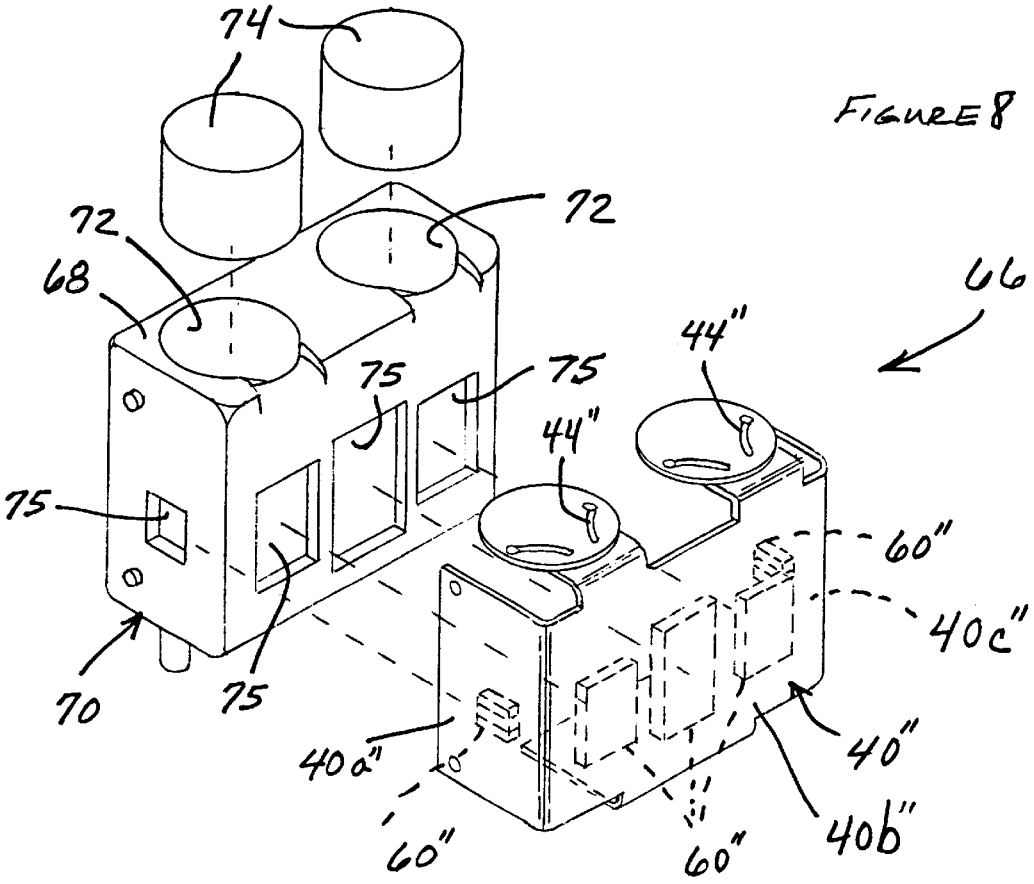
FIG. 8 is an exploded perspective view of the conformable circuit element being used in connection with a central core and a pair of loaded waveguides to form a waveguide radiator.

Referring to FIG. 8, another alternative implementation of the conformable circuit element 40" forming a broadside waveguide radiator 66 is illustrated. In this implementation, flip chip MMICs and ASICs 60" are coupled directly to the conformable circuit element 40" on three orthogonal planes 40*a*", 40*b*" and 40*c*", which each extend orthogonal to the aperture plane 68. A central core 70 is employed having a pair of circular recesses 72 within which are received a pair of loaded waveguides 74. The radiating elements 44" lie over the loaded waveguides 74 when the circuit element 40" is secured to the central core 70. The central core 70 also has a plurality of recesses 75 formed thereon at positions corresponding to the placement of the MMICs and ASICs 60" to partially house the MMICs and ASICs therein.

Figure 9:
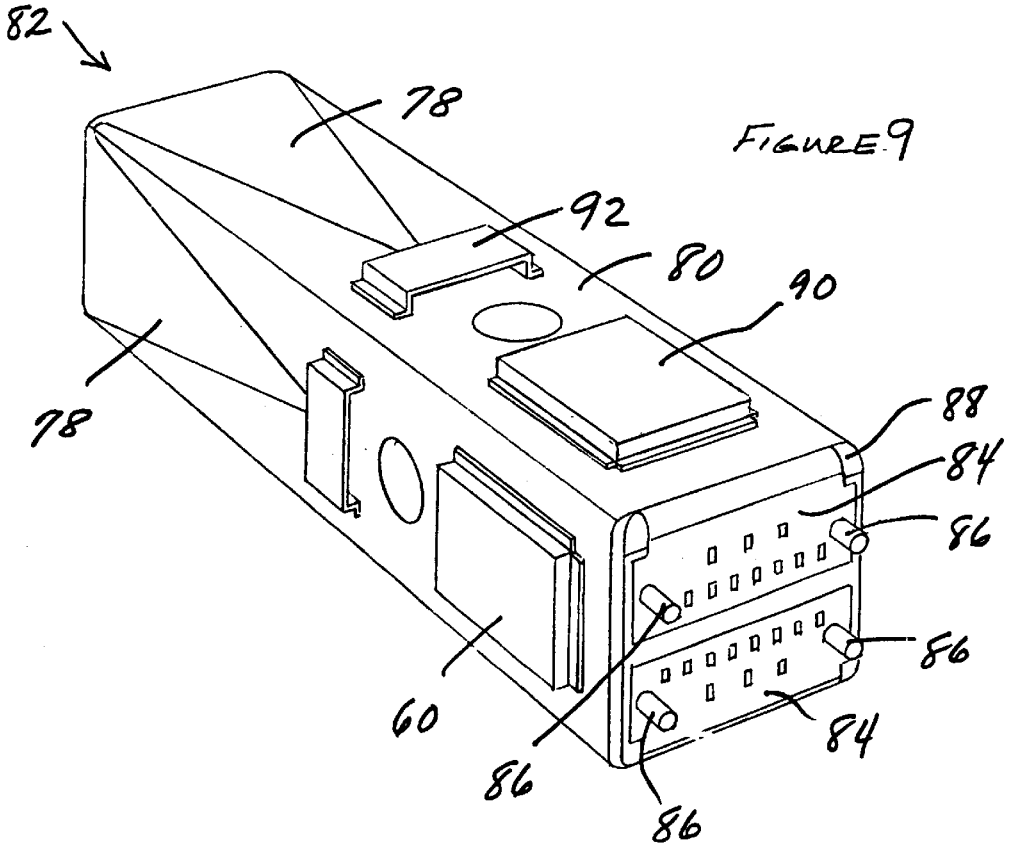
FIG. 9 is a perspective view of an antenna incorporating the conformable circuit element of the present invention, and including orthogonal bilateral Vivaldi elements.

Referring to FIG. 9, an antenna 82 module in accordance with yet another implementation of the present invention is illustrated. In this implementation, a conformable circuit element 80 is wrapped around a mandrel or core element 88 and incorporates four bilateral Vivaldi end-fire elements 78 (only two being visible) that are formed on four orthogonal planes. The control electronics (i.e., MMICs 60 and/or optional power combiner/splitters 48) are mounted on the same plane as the Vivaldi radiating elements 78, hidden underneath shielding covers 90 and 92, and combined through the conformable circuit element 80 to form two independent three-beam outputs. Output pads 84 and alignment posts 86 are placed at one end thereof. The conformable circuit element 80 is further preferably bonded to itself to maintain the geometry of the antenna module 82.

Figure 10:
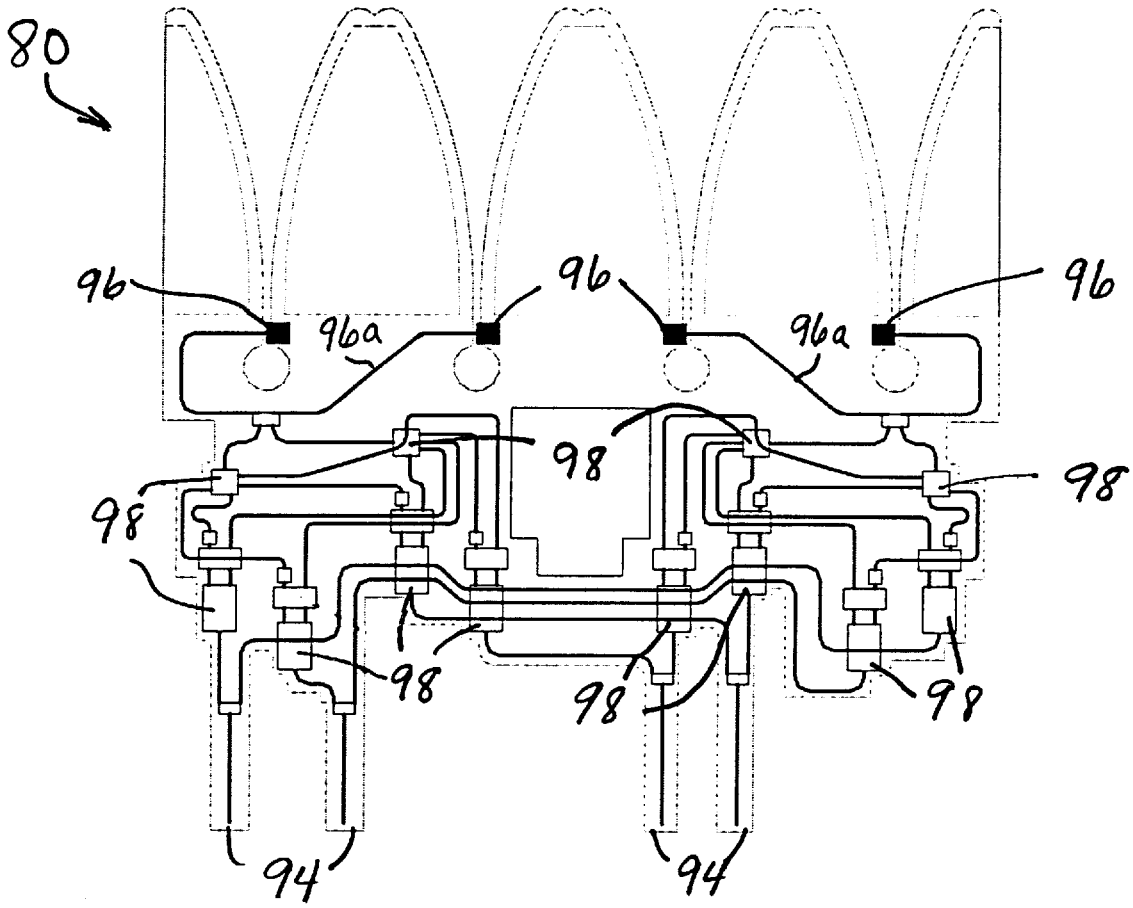
FIG. 10 is a plan view of the conformable circuit element of FIG. 9 with the element laid flat.

Referring briefly to FIG. 10, the conformable circuit element 80 is shown laid flat before being secured to the core element 88 to form the rectangular shape shown in FIG. 9. The transmission feed lines 94, radiating elements 96, MMICs and ASICs 98, and transmission lines 96*a* can also be seen in this view.

Figure 11:
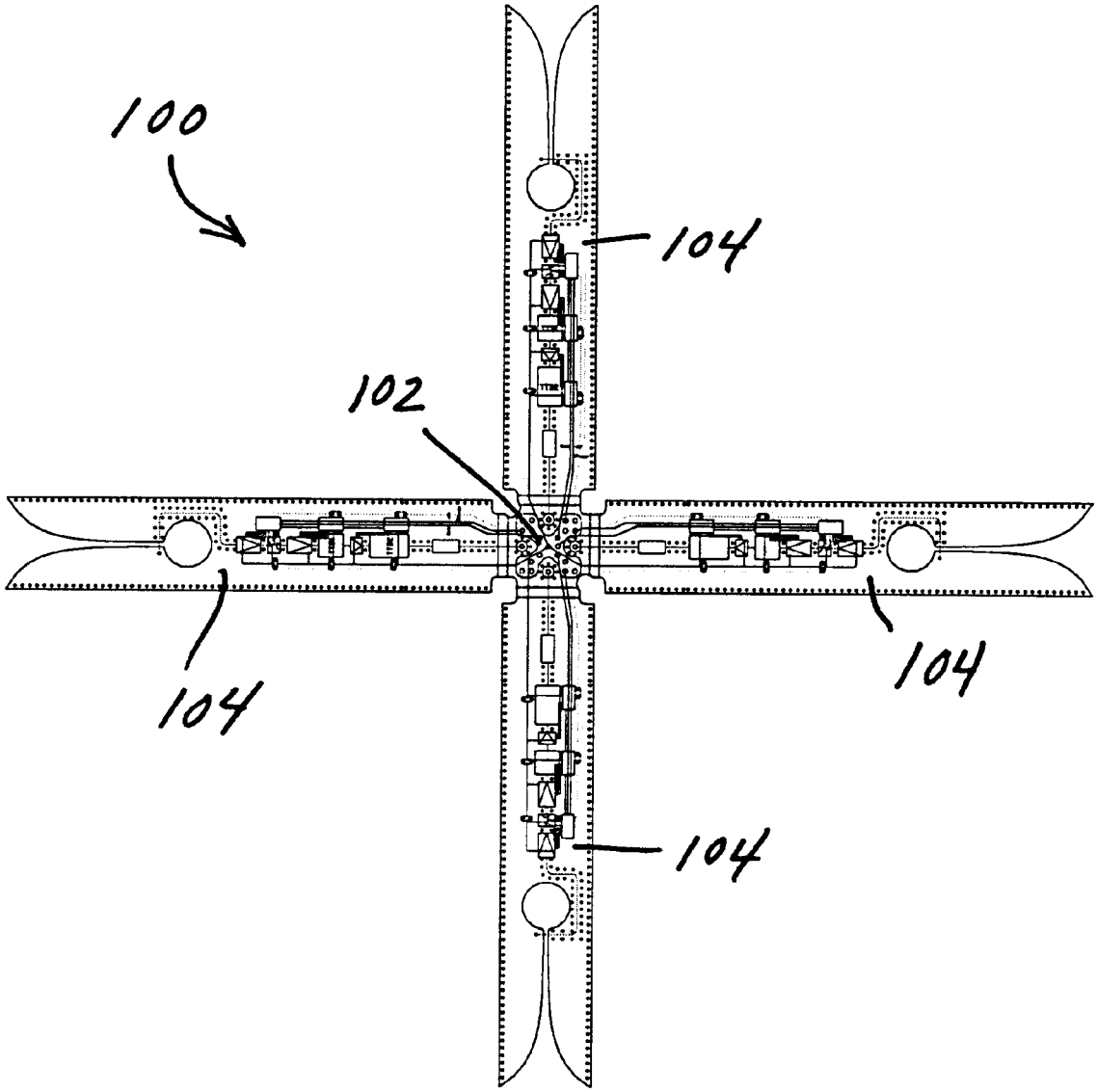
FIG. 11 is a plan view of an alternative preferred layout of the conformable circuit element of FIG. 10, wherein the folds are all made about a central portion of the circuit element similar to the embodiment of FIG. 5.
Figure 1:
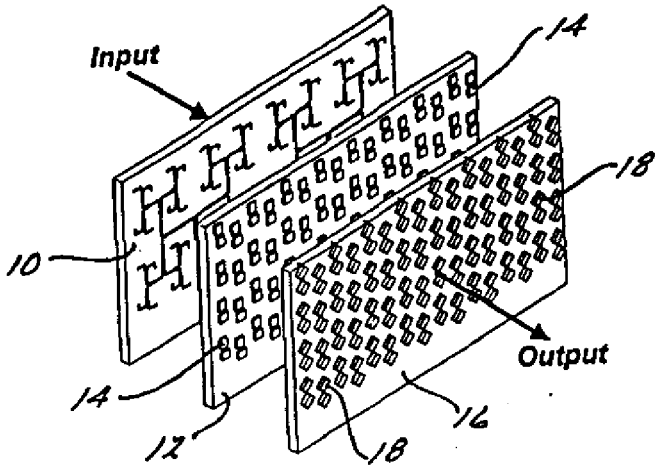
Prior Art Fig. 1.
Figure 2:
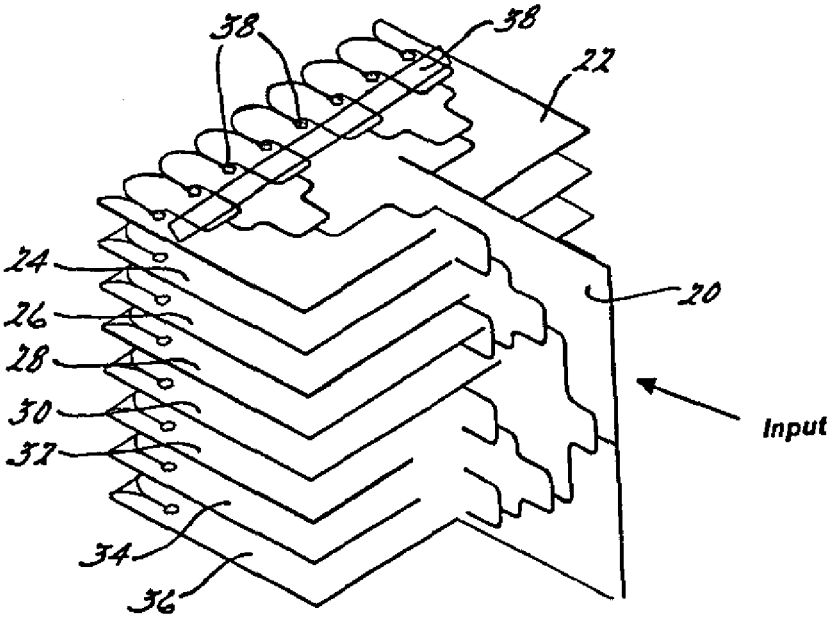
Prior Art Fig. 2.
Figure 3:
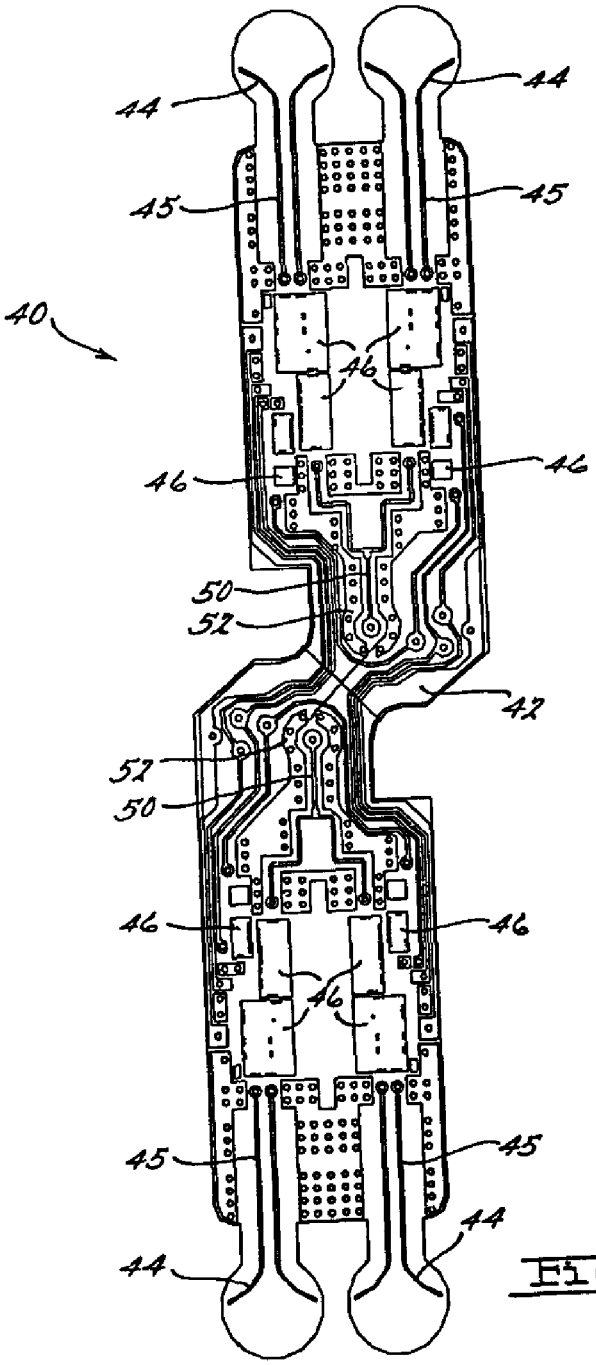
Figure 4:
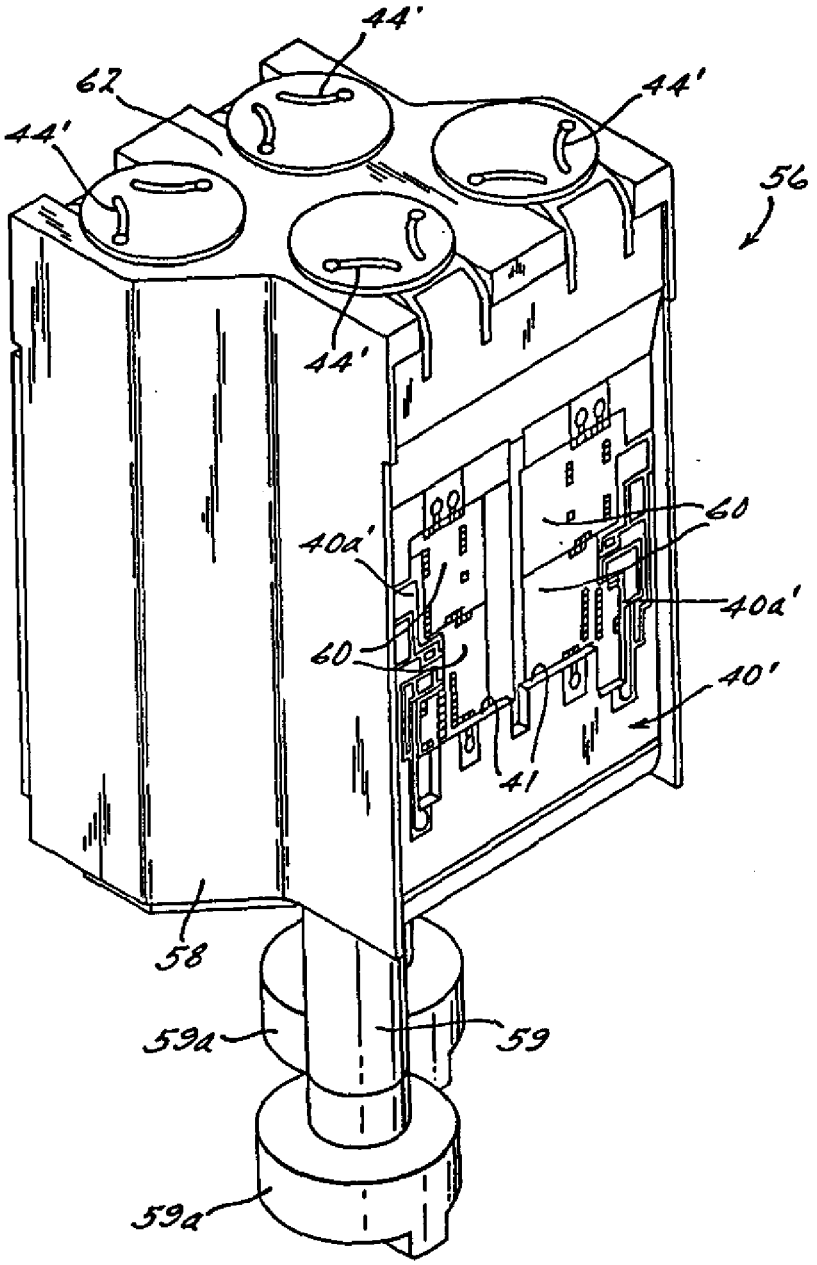
Figure 5:
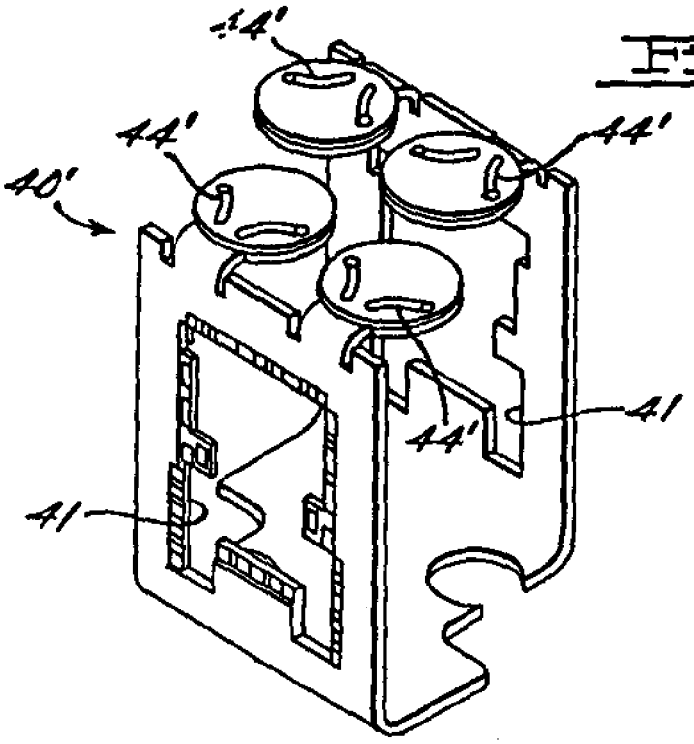
Figure 5A:
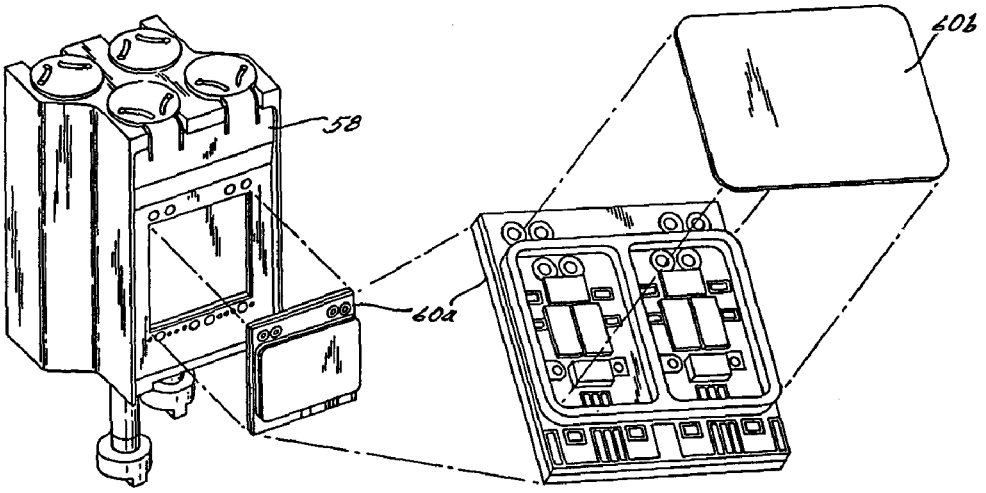
Figure 6:
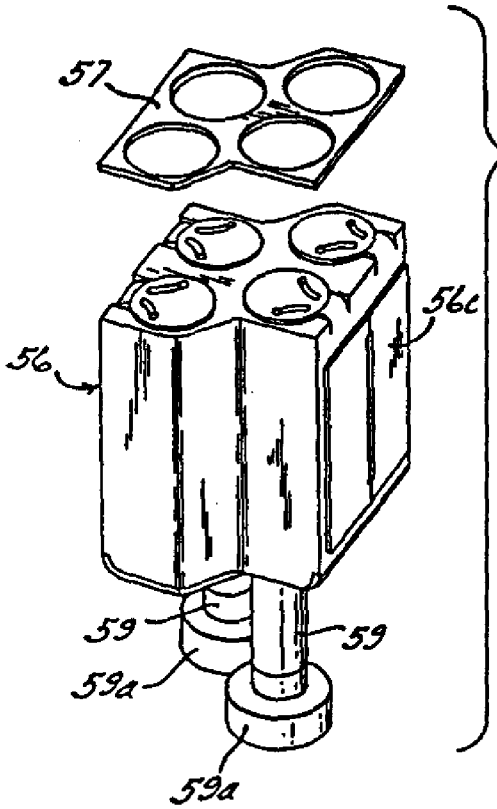
Figure 7:
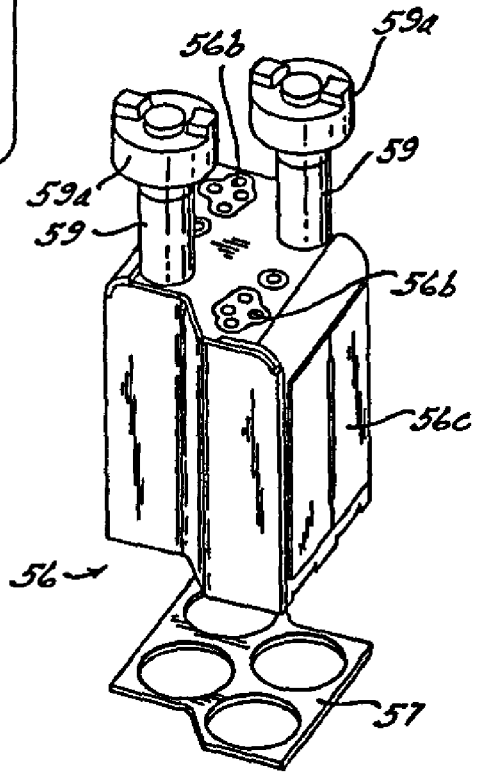
Figure 8:
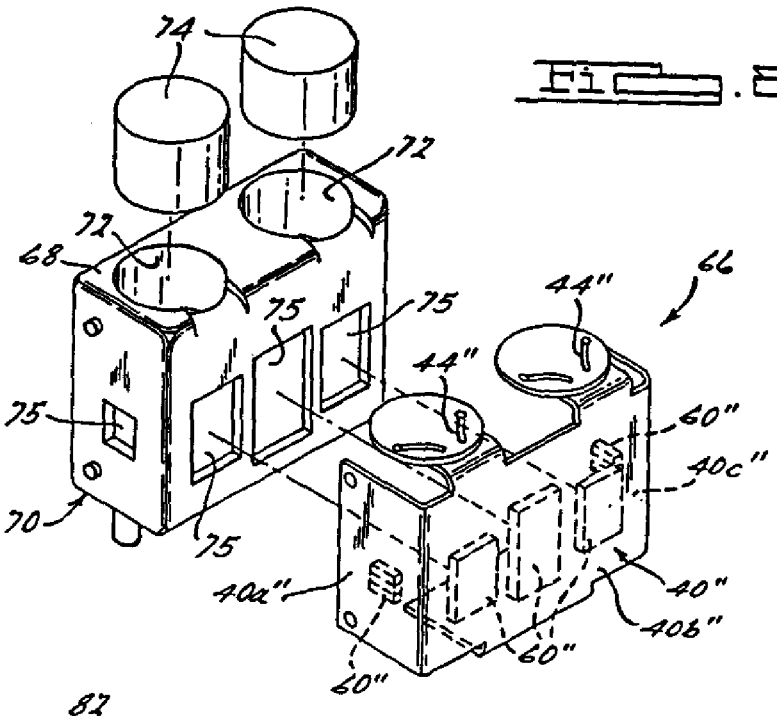
Figure 9:
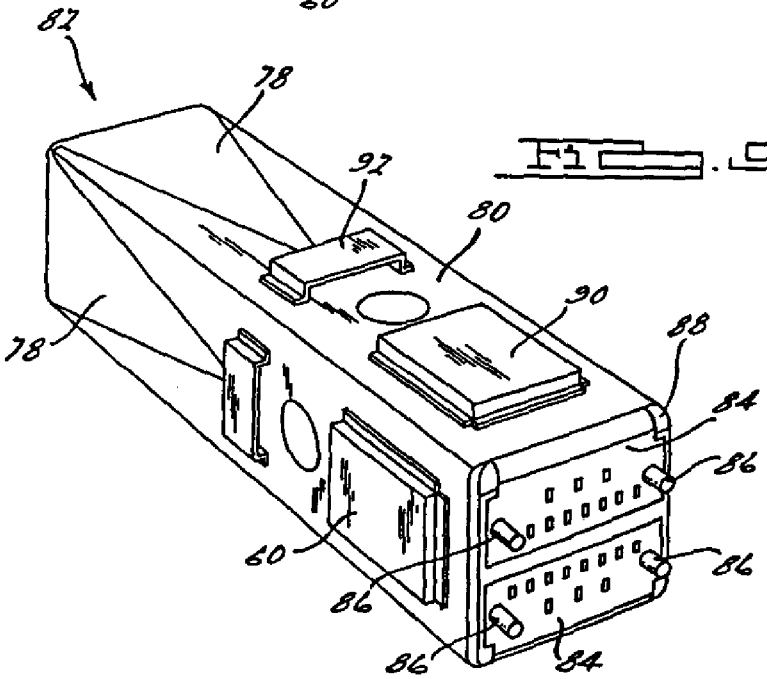
Figure 10:
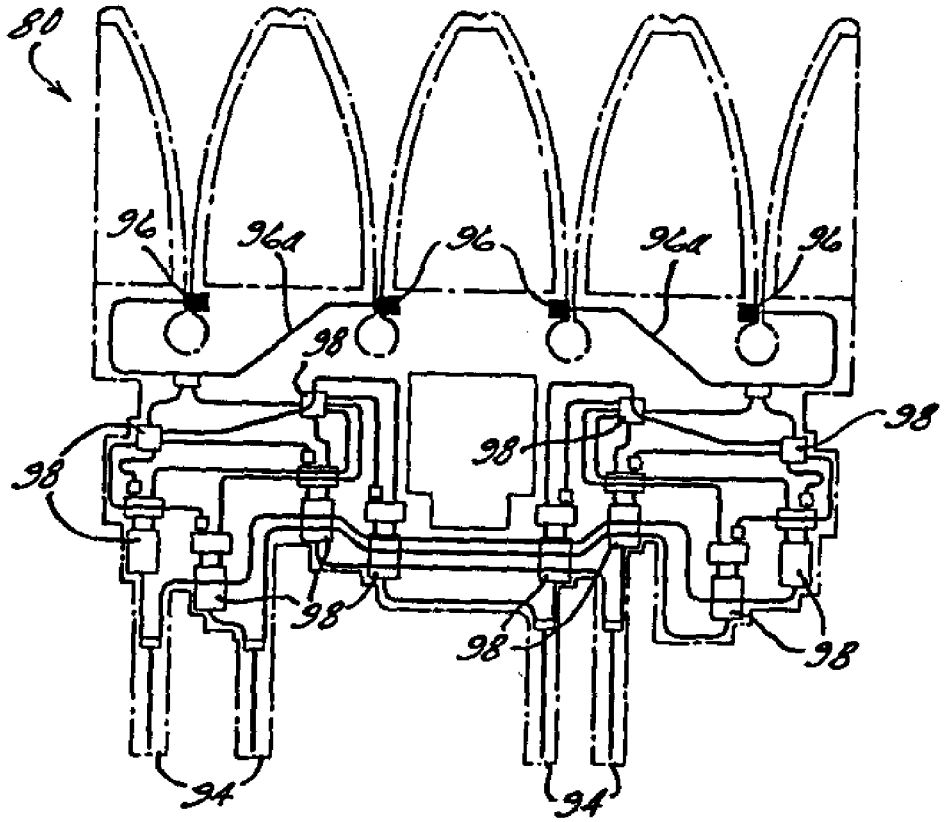
Figure 11:
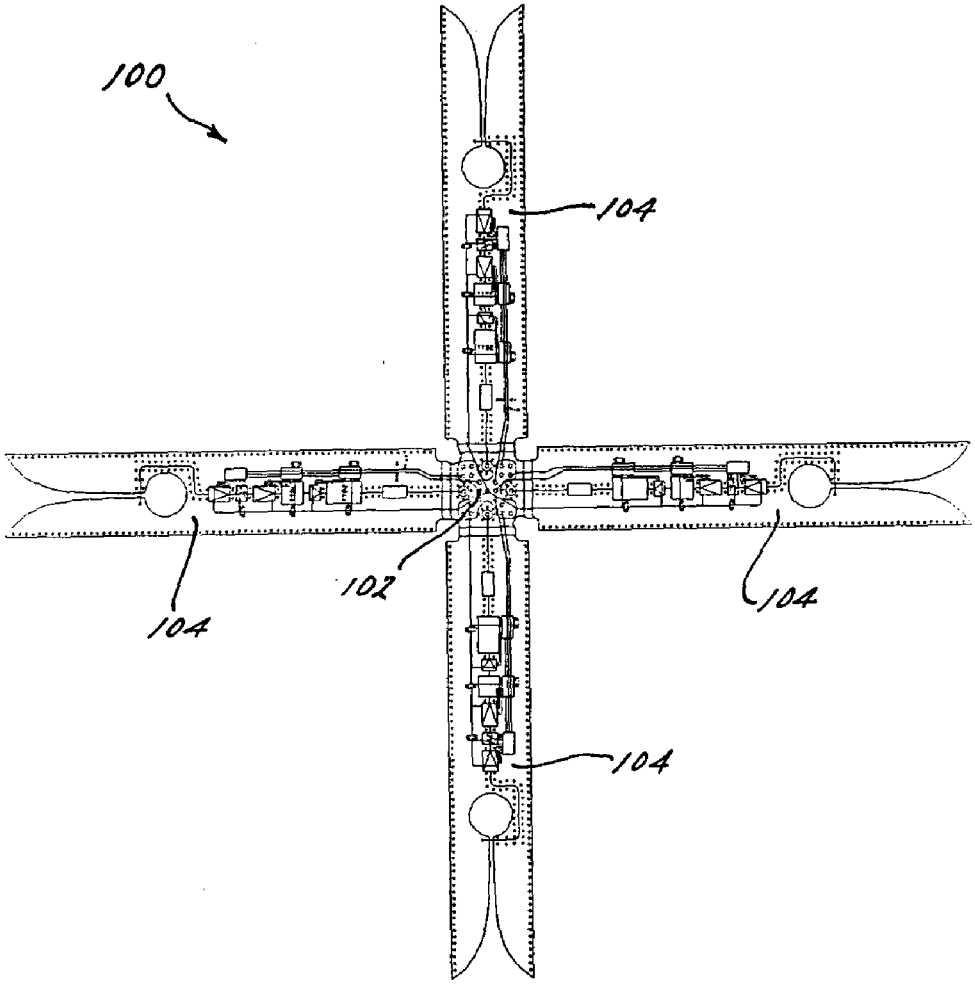

FIG. 11 shows an alternative preferred form 100 of the conformable circuit element 80 of FIG. 9, wherein the conformable circuit element is formed with a central region 102 such that four sections 104 are placed perpendicular to one another when attached to a mandrel (not shown).

From the foregoing, it will be appreciated that the conformable circuit element described herein lends itself readily to a variety of implementations. Importantly, the elimination of large pluralities of external interconnects allows extremely tight radiating element spacing to be achieved, while also reducing the cost and manufacturing complexity of a high frequency phased array antenna incorporating the conformable circuit element. This enables phased array antennas having large pluralities of radiating elements to be constructed even more cost effectively than with previously developed packaging architectures. As a result, the present invention allows electronically scanned, phased array antennas to be used in a variety of implementations where previously developed packaging architectures would have resulted in an antenna that would be too costly to implement.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An electronically steerable phased array antenna module comprising:

a conformable circuit element;

a plurality of radiating elements integrally formed on said conformable circuit element;

a plurality of beam steering elements electrically coupled to said conformable circuit element;

a plurality of interconnecting elements integrally formed on said conformable circuit element for enabling coupling of said radiating elements to said beam steering elements;

a central core;

wherein said conformable circuit element is secured to said central core;

wherein said conformable circuit element comprises first, second and third portions, and wherein said radiating elements are disposed on said first portion, at least one of said beam steering elements is disposed on said second portion which extends generally orthogonal to said first portion, and wherein at least one of said beam steering elements is disposed on said third portion of said conformable circuit element and extends generally orthogonal to said first and second portions.

2. The antenna module of claim 1, further comprising:

a power control element electrically coupled to said conformable circuit element; and a plurality of power feed elements integrally formed on said conformable circuit element for coupling said power control elements with said beam steering elements.

3. The antenna module of claim 2, further comprising a plurality of monolithic transmission feed lines integrally formed on said conformable circuit element; and an output pad comprising a plurality of outputs in communication with said monolithic transmission feed line.

4. The antenna module of claim 1, wherein said central core comprises a waveguide.

5. The antenna module of claim 2, wherein each of said radiating elements comprises a Vivaldi element.

6. An electronically steerable phased array antenna module comprising:

a conformable circuit element;

a plurality of radiating elements monolithically etched onto said conformable circuit element;

a corresponding plurality of monolithic microwave integrated circuits (MMICS) mounted on said conformable circuit element;

a plurality of interconnecting elements etched on said conformable circuit element for enabling coupling of said radiating elements to said monolithic microwave integrated circuits;

a plurality of power control circuits secured to said conformable circuit element;

a plurality of monolithic feed transmission lines formed on said conformable circuit element for coupling said power control circuits with a plurality of output pads;

a core element to which said conformable circuit element is mounted; and wherein a first portion of said conformable circuit element includes said radiating elements, and wherein said first portion is positioned on said core element to extend orthogonally to a second portion of said conformable circuit element, wherein said second portion includes said monolithic microwave integrated circuits.

7. The antenna module of claim 6, wherein said core element comprises a plurality of loaded waveguides.

8. The antenna module of claim 6, wherein said radiating elements comprise Vivaldi elements.

9. A method for forming a phased array antenna module comprising the steps of:

providing a conformable circuit element that can be disposed in a non-planar configuration;

integrally forming on said conformable circuit element a plurality of radiating elements and a plurality of transmission lines in communication with said radiating elements;

electrically coupling a plurality of beam steering elements to said plurality of transmission lines;

securing said conformable circuit element to a core element such that a first portion of said conformable circuit element includes said radiating elements and is disposed orthogonally to a secured portion of said conformable circuit element, and wherein said second portion includes a beam steering element.

10. The method of claim 9, further comprising the steps of:

integrally forming a plurality of feed transmission lines on said conformable circuit element;

integrally forming a plurality of output pads on said conformable circuit element, said output pads being in electrical communication with said feed transmission lines.

* * * * *

UNITED STATES PATENT AND TRADEMARK OFFICE

CERTIFICATE OF CORRECTION

PATENT NO. : 6,424,313 B1
DATED : July 23, 2002
INVENTOR(S) : Navarro et al.

It is certified that error appears in the above-identified patent and that said Letters Patent is hereby corrected as shown below:

Drawings,
Replace drawing Figs. 1-11 wth the attached drawings Figs. 1-11.

Signed and Sealed this

Seventeenth Day of June, 2003

JAMES E. ROGAN
*Director of the United States Patent and Trademark Office*